US008069516B2

(12) United States Patent
Hasan et al.

(10) Patent No.: US 8,069,516 B2
(45) **Date of Patent: *Dec. 6, 2011**

(54) SPACE SAVER PILLOW SYSTEM AND METHOD FOR MAKING THE SAME

(75) Inventors: Saher Hasan, Round Lake, IL (US); Amy M. Lamberg, Palatine, IL (US); James B. Robertson, Libertyville, IL (US)

(73) Assignee: Medline Industries, Inc., Mundelein, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/715,031

(22) Filed: Mar. 1, 2010

(65) Prior Publication Data

US 2010/0154123 A1 Jun. 24, 2010

Related U.S. Application Data

(63) Continuation of application No. 11/635,892, filed on Dec. 8, 2006, now Pat. No. 7,698,762.

(60) Provisional application No. 60/748,975, filed on Dec. 9, 2005.

(51) Int. Cl.

| | |
|---|---|
| ***A47G 9/10*** | (2006.01) |
| ***B65B 31/00*** | (2006.01) |
| ***B65D 81/20*** | (2006.01) |

(52) U.S. Cl. ..... 5/636; 206/524.8; 53/434

(58) Field of Classification Search ..... 5/636–645, 5/709; 53/434; 206/524.8

See application file for complete search history.

(56) References Cited

U.S. PATENT DOCUMENTS

| | | | | |
|---|---|---|---|---|
| 2,764,859 | A * | 10/1956 | Hanselmann | 53/434 |
| 3,638,255 | A * | 2/1972 | Sterrett | 5/641 |
| 3,968,620 | A | 7/1976 | Keltner | |
| 4,054,204 | A | 10/1977 | Keeton | |
| 4,277,859 | A | 7/1981 | Seaman | |
| 4,670,924 | A | 6/1987 | Spector | |
| 4,717,613 | A | 1/1988 | Ottaviano | |
| 4,763,369 | A | 8/1988 | Spector | |
| 4,768,247 | A | 9/1988 | Beier | |
| 4,889,388 | A | 12/1989 | Hime | |
| 4,916,765 | A | 4/1990 | Castronovo, Jr. | |
| 5,068,933 | A | 12/1991 | Sexton | |
| 5,179,741 | A | 1/1993 | Book | |

(Continued)

FOREIGN PATENT DOCUMENTS

WO WO 2005/072175 8/2005

OTHER PUBLICATIONS

Brochure entitled "Reusable Pillows from Medline," Medline Industries, Inc., 6 pages, Feb. 2005.

(Continued)

*Primary Examiner* — Michael Trettel
(74) *Attorney, Agent, or Firm* — Nixon Peabody LLP

(57) ABSTRACT

A space saver pillow system comprises a space saver pillow and a bag. The space saver pillow includes a fill and a covering surrounding and enclosing the fill. The fill of the space saver pillow is adapted to generally rebound back to its natural state after being compressed. The bag encloses the space saver pillow and an amount of air. The space saver pillow enclosed in the bag is compressed no more than about 80% of its original size.

10 Claims, 3 Drawing Sheets

U.S. PATENT DOCUMENTS

| | | | | |
|---|---|---|---|---|
| D347,789 | S | 6/1994 | Kaplan | |
| 5,689,844 | A | 11/1997 | Liu | |
| 5,802,644 | A | 9/1998 | Scheurer | |
| 5,839,138 | A | 11/1998 | Weidman et al. | |
| 5,878,551 | A * | 3/1999 | Curley et al. | 53/434 |
| 5,926,879 | A | 7/1999 | Davis | |
| 6,023,797 | A | 2/2000 | Brumfield | |
| 6,029,428 | A | 2/2000 | Terminella et al. | |
| 6,216,297 | B1 | 4/2001 | Lemke | |
| 6,230,349 | B1 | 5/2001 | Silver et al. | |
| 6,347,421 | B1 | 2/2002 | D'Emilio | |
| 6,453,644 | B1 | 9/2002 | Baker | |
| 6,708,343 | B1 | 3/2004 | Ceron | |
| 6,860,089 | B2 | 3/2005 | VanAlstine | |
| 6,952,906 | B2 * | 10/2005 | Nelson | 53/434 |
| 7,059,101 | B2 * | 6/2006 | Dextraze et al. | 53/399 |
| 7,374,045 | B2 * | 5/2008 | DiLiberto | 206/524.8 |
| 7,698,762 | B2 * | 4/2010 | Hasan et al. | 5/634 |
| 2006/0138013 | A1 * | 6/2006 | Lamstein | 206/524.8 |

OTHER PUBLICATIONS

Canadian Office Action; Canadian Patent Application No. 2,570,722. Dated Apr. 2, 2009 (3 pages).

* cited by examiner

SPACE SAVER PILLOW SYSTEM AND METHOD FOR MAKING THE SAME

CROSS-REFERENCE TO RELATED APPLICATION

This application is a continuation of pending U.S. patent application Ser. No. 11/635,892, filed Dec. 8, 2006, now U.S. Pat. No. 7,698,762 and titled "Space Saver Pillow System And Method For Making The Same," which claims the benefit of priority from U.S. Provisional Application No. 60/748,975, filed Dec. 9, 2005, which are hereby incorporated by reference in their entirety.

FIELD OF THE INVENTION

The present invention relates to pillows and methods for making pillows. More specifically, the present invention relates to a space saving pillow system and a method for making the same.

BACKGROUND OF THE INVENTION

Businesses and individuals often times look for ways to reduce storage and packing space whether it be for storage and/or mass shipment of products. The need for space is especially true in the health care industry where it is particularly necessary for organizations such as hospitals and nursing homes to store a large number of supplies, such as new and clean pillows. However, storage space in these facilities is usually far from plentiful and some products, such as pillows, tend to take up quite a bit of space.

In relation to pillows, the above-identified issues have been addressed in the past by rolling and/or compressing pillows. However, various additional issues arise when rolling a pillow. For example, difficulties have been encountered in producing a smooth, uniform roll that is compact and stable. Some pillow arrangements are difficult to secure and stabilize in the rolled-up configuration. Compressing pillows (i.e., by vacuum packing) typically allows one to reduce the size of the pillow more so than rolling the pillow. However, in doing so, a different set of problems arise. Specifically, due to the amount of compression and the fill material typically used in pillows, the pillow typically becomes over-compressed. Upon decompression, the ability of the pillow to rebound back to its original shape is hindered and the pillow often times remains deformed in shape.

Accordingly, to meet the need for a pillow which can significantly be reduced in size without compromising the integrity and ability of the pillow to rebound back to its original shape upon decompression, the present inventors have developed a pillow and method of compression which addresses these issues.

SUMMARY OF THE INVENTION

According to one aspect, a space saver pillow system comprises a space saver pillow and a bag. The space saver pillow includes a fill and a covering surrounding and enclosing the fill. The fill of the space saver pillow is adapted to rebound back to its natural state after being compressed. The bag encloses the space saver pillow and an amount of air. The space saver pillow enclosed in the bag is compressed no more than about 80% of its original size.

According to another aspect, a space saver pillow system comprises a space saver pillow and a bag. The space saver pillow includes a hollow-siliconized garnetted polyester fill and a covering surrounding and enclosing the fill. The bag encloses the space saver pillow and an amount of air. The space saver pillow enclosed in the bag is compressed no more than approximately 80% of its original size.

According to yet another aspect, a method for vacuum-packing a space saver pillow comprises providing a space saver pillow including a fill and a covering surrounding and enclosing the fill. The fill is adapted to be compressed and generally rebound back to its natural state upon decompression. The method further comprises placing the space saver pillow in a bag. The method additionally includes vacuuming the air out of the bag so as to compress the space saver pillow to no more than approximately 80% of its original size. The method still further includes heat sealing the bag.

According to still another aspect, a space saver pillow system comprises a space saver pillow and a bag. The space saver pillow includes a fill and a covering surrounding and enclosing the fill. The fill is adapted to generally rebound back to its natural state after being compressed. The bag encloses the space saver pillow and an amount of air. The space saver pillow is compressed to a portion of its original size while remaining capable of rebounding back to its natural state. The space saver pillow is compressed from approximately 60% to approximately 80% of its original size.

The above summary of the present invention is not intended to represent each embodiment or every aspect of the present invention. The detailed description and Figures will describe many of the embodiments and aspects of the present invention.

BRIEF DESCRIPTION OF DRAWINGS

The foregoing and other advantages of the invention will become apparent upon reading the following detailed description and upon reference to the drawings.

Figure 1:
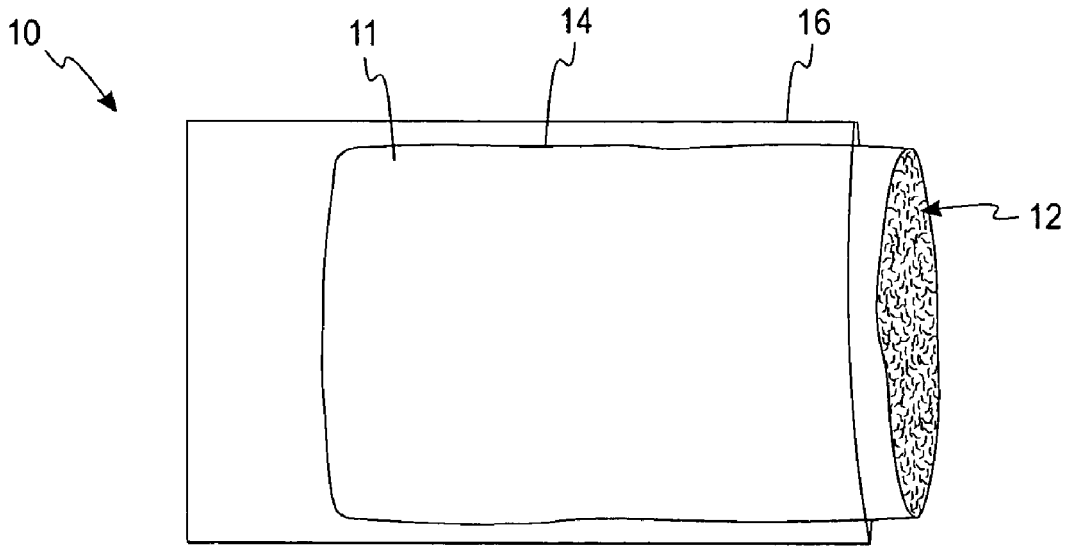
FIG. 1 is a broken front view of the space saver pillow system.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

Referring to FIG. 1, a space saver pillow system 10 is illustrated. The space saver pillow system 10 comprises a space saver pillow 11 and a bag 16. However, in other embodiments, the space saver pillow system 10 may comprise a plurality of space saver pillows 11 and a bag 16 (not illustrated). For example, in some embodiments, the space saver pillow system may comprise two space saver pillows enclosed within a bag. The space saver pillow 11 comprises fill 12 and a covering 14. The fill 12 is surrounded and enclosed by the covering 14. The covering 14, the fill 12 (i.e., the space saver pillow 11) and an amount of air are surrounded and enclosed by the bag 16. The space saver pillow system 10 is adapted to be compressed to save storage space and/or freight costs while shipping. One method of compression is vacuum-packing. Another method of compression includes the application of pressure. The space saver pillow system 10 can also easily be decompressed so that it rebounds to its natural state when ready for use. In other words, the space saver pillow 11 of the space saver pillow system 10 easily regains its natural non-compressed shape and size.

The fill 12 is comprised of a material, such as fibers, that can be readily compressed and decompressed without impairing the ability of the space saver pillow 11 to rebound to its normal state after compression. One such material that can be used for the fill 12 is hollow-siliconized garnetted polyester. In one embodiment, the hollow-siliconized garnetted polyester fill is a fibrous material. Material chosen for the fill can vary depending on the blend of fiber or the length of time the space saver pillow 11 is in the compressed state. In one embodiment, the blend of fiber includes hollow slick fiber that is 7 denier combined with hollow slick staple fiber that is 6 denier. While not intending to be bound by any particular theory of operation, it is believed that silicone reduces the friction between the fibers which increases the mobility of the fibers and thereby provides comfort to the user and better ability to rebound back to its natural state subsequent to compression. Additionally, the fill 12 is selected so as to enable the space saver pillow 11 to be comfortable during use.

The covering 14 is adapted to surround and enclose the fill 12. In one embodiment, the covering 14 is a woven nylon with laminate. While not intending to be bound by any particular theory, it is believed that woven nylon laminate is wipeable, inherently antimicrobial, and wrinkle-resistant. Other non-limiting materials that can be used for the covering 14 include cottons, polypropylenes, polyethylenes, olefins, and non-woven materials. An important characteristic of the covering 14 is that the covering 14 not provide an air-tight seal around the fill 12. The materials chosen for the covering 14 can also vary depending on comfort, cleanliness, stain resistance, flame retardation, and wipeability.

The bag 16 is adapted to provide an air-tight environment surrounding the fill 12 and the covering 14 to enable the space saver pillow system 10 to be compressed via vacuum-packing or other compression techniques. Accordingly, in one embodiment, the bag 16 is comprised of plastic. However, other materials for the bag 16 that ensure an air-tight environment when vacuum-packed or otherwise compressed may also be used. Generally, the materials chosen for the bag 16 depend on their ability to be compressed and ensure an air-tight environment.

Various amounts and sizes of the fill 12, the covering 14, and the bag 16 can be used in the space saver pillow system 10. In one embodiment, about 14 ounces (about 397 grams) to about 20 ounces (about 567 grams) of the fill is used to produce a space saver pillow having dimensions between about 16 inches (about 41 centimeters) and about 22 inches (about 56 centimeters) wide and between about 22 inches (about 56 centimeters) and 28 inches (about 71 centimeters) long. In one embodiment, about 16 ounces (about 454 grams) of the fill are used to produce a 20×26 inch (51×60 centimeter) space saver pillow. In another embodiment, about 16 ounces (about 454 grams) of the fill are used to produce a 18×24 inch (46×61 centimeter) space saver pillow. The bag should be between about 18 inches (about 46 centimeters) and about 24 inches (61 centimeters) wide and between about 28 inches (about 71 centimeters) and 34 inches (about 86 centimeters) long. In some embodiments, the bag is 21.5×31 inches (55×79 centimeters).

Figure 2:
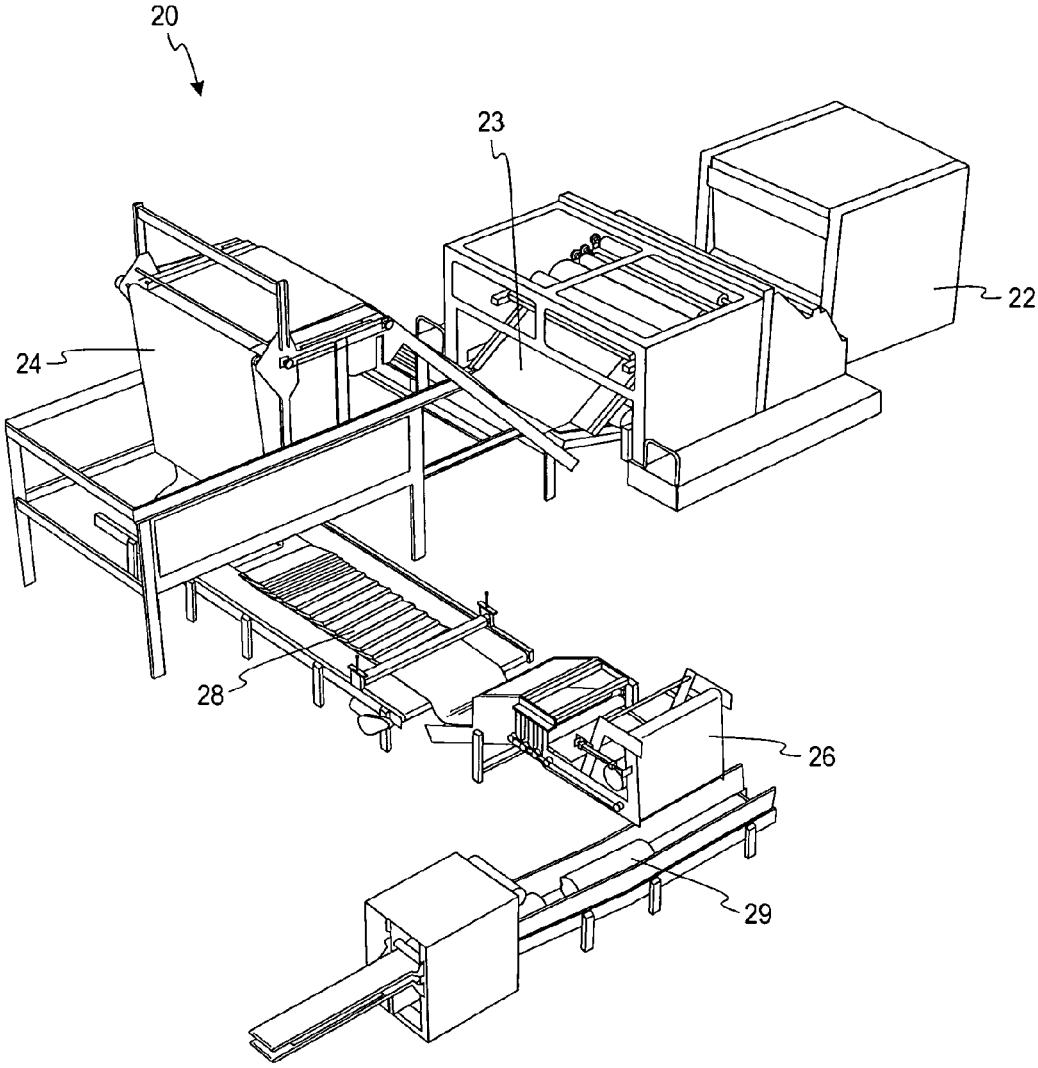
FIG. 2 is a perspective view of the machines used to manufacture the space saver pillow according to one embodiment.

The space saver pillow 11 can be formed using any number of standard pillow-filling techniques from standard layering of the fill 12 to blowing the fill 12 into the covering 14. In one embodiment, the space saver pillow 11 is formed using various machines 20 seen in FIG. 2. The machines 20 used in this embodiment include a Garnett Carding machine 22, a Cross Lapper machine 24, and a Wind-Cut, Duff System 26. These commercial machines are manufactured by various companies, such as SliverTex Engineers Private Limited of Coimbatore, Tamil Nadu, India. Referring to FIG. 2, a bale (now shown) of compressed fiber is put into the Garnet Carding machine 22. The Garnet Carding machine 22 grinds, combs, heats, and lightly fuses the fiber to create a webbing consisting of the fill 12 (see FIG. 1). Once through the Garnet Carding machine 22, the webbing of the fill 12 enters the Cross Lapper machine 24 via a conveyor belt 23. The Cross Lapper machine 24 swings over a second conveyor belt 28 to fold the webbing of the fill 12 in layers to a predetermined weight. The layers of the webbing of the fill 12 are laid generally at about a 45° angle on the conveyor belt 28, but other angles may also be used. By layering the fill 12 in this manner, better recovery may be provided than by other methods of layering or blowing the fill 12. This method of layering the fill 12 also builds strength, loft and integrity in the webbing and limits the amount of "bunching up" of the fill 12 so that the surface of the covering 14 (see FIG. 1) is generally smooth. The recovery and memory is enhanced through automation because of the precise control of the exact angle of the layering and the amount of fill 12. Once the fill 12 has traveled along the conveyor belt 28, the fill 12 enters the Wind-Cut, Duff System 26. The Wind-Cut, Duff System 26 mechanically cuts the layered fill 12 and forms the fill into a "log" 29. The Wind-Cut, Duff System 26 then inserts the fill 12 into the covering 14, giving evenness in the fill 12. This space saver pillow 11 produced by such pillow-filling techniques is then placed in the bag 16, as described above with respect to FIG. 1.

The space saver pillow system 10 can then be compressed in a variety of ways. As mentioned above, one preferred method of compression is vacuum-packing. One example of a vacuum-packing machine is the Minipack MV Swing Lid—Chamber Vacuum Sealer available from Minipack-America LLC of Orange, Calif. To vacuum-pack, the space saver pillow 11 is first placed in the bag 16. To use the vacuum-packing machine, the opening of the bag 16 is lined along a track. In one embodiment, a cover of the vacuum-packing machine is closed and the air is vacuumed out of the bag 16 to a preferred compression rate of about 80% (i.e., the pillow 11 is compressed to about 80% of its original size while maintaining its ability to generally rebound back to its original shape upon decompression). The bag is then heat-sealed. Other vacuum-packing techniques may also be used such as compression packing, rolling and packing.

However, regardless of the precise steps taken to vacuum-pack or otherwise compress the space saver pillow 11, it is important that the space saver pillow is not compressed more than about 80% and, in some embodiments, not more than about 90%. It is believed that such compression rates contribute to the ability of the pillow to rebound back to its natural state. For example, by having a compression rate of about 80%, it is meant that the pillow should rebound to at least about 80% of its original size while maintaining its ability to generally rebound back to its original loft upon decompression. The term "loft" relates to the general "fluffiness" of the pillow. However, a compression rate too far below 80% would not provide optimal space-saving benefits. Accordingly, the compression rate should generally be between about 60% to about 80% to enable optimal space-saving and rebound reaction. By compressing above about 60%, but below about 80% and, in some embodiments, below about 90%, the space saver pillow 11 is still compressed enough to provide adequate space-saving, but also retains the ability to sufficiently decompress.

Figure 3:
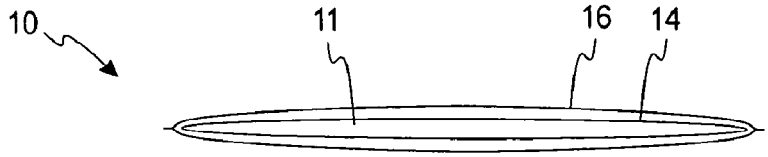
FIG. 3 is a side view of the space saver pillow system in the compressed state.
Figure 4:
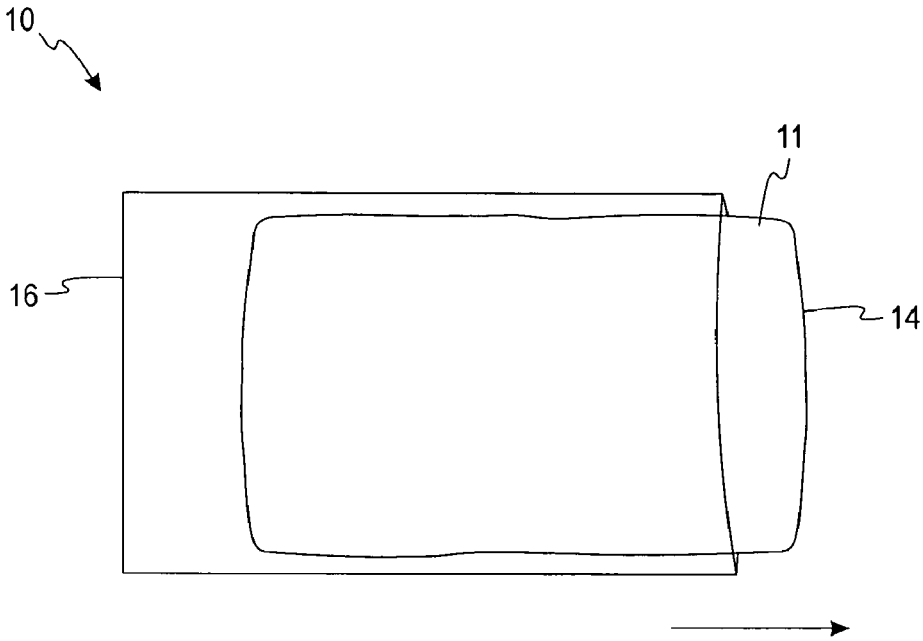
FIG. 4 is a front view of the space saver pillow of the space saver pillow system being removed from its surrounding bag.

Once compressed, the space saver pillow system 10 will appear as illustrated in FIG. 3. The space saver pillow 11 will be between about 1 inches (about 2 centimeters) and about 4 inches (10 centimeters) in height upon compression. In some embodiments, the space saver pillow system 10 will be about 2 inches (5 centimeters) in height upon compression. The space saver pillow system 10 is now in optimal position to be stored (such as in a hospital for example) and/or shipped (thereby reducing freight costs). To use the space saver pillow 11 of the space saver pillow system 10, one simply removes the space saver pillow 11 from the bag 16, as shown in FIG. 4. The pillow 11 may be removed from the bag 16 in a variety of ways including cutting the bag 16 open with scissors. For optimal recovery to its previously uncompressed state, one should gently shake the space saver pillow by holding at opposite edges.

In some embodiments, the space saver pillow 11 may rebound to at least about 80% of its original loft within about 1 to about 4 hours. Within about 24 hours, the space saver pillow 11 in these embodiments rebounds to at least about 90% of its original loft, and after 24 hours, the space saver pillow 11 in these embodiments rebounds to greater than about 90% of its original loft.

According to alternative embodiment A, a space saver pillow system comprises a space saver pillow having a fill adapted to be compressed and rebound generally back to its natural state and a covering surrounding and enclosing the fill, and a bag enclosing the space saver pillow, the bag being adapted to have the air within the bag removed so that the space saver pillow is compressed no more than approximately 80%.

According to alternative embodiment B, the space saver pillow of alternative embodiment A, wherein the fill is a hollow-siliconized garnetted polyester.

According to alternative embodiment C, the space saver pillow of alternative embodiment A, wherein the covering is a woven nylon with laminate.

According to alternative embodiment D, the space saver pillow of alternative embodiment A, wherein the bag is plastic.

According to alternative embodiment E, the space saver pillow of alternative embodiment A, wherein the air is removed from within the bag so that the space saver pillow is compressed no less than approximately 60%.

According to alternative embodiment F, the space saver pillow system of alternative embodiment A, wherein the air from within the bag is removed so that the space saver pillow is compressed within the range of approximately 60% to approximately 80%.

According to alternative embodiment G, a space saver pillow system comprises a space saver pillow having a hollow-siliconized garnetted polyester fill and a covering surrounding and enclosing the fill, and a bag enclosing the space saver pillow, the bag being adapted to have the air from within the bag removed so that the space saver pillow is compressed no more than approximately 80%.

According to alternative embodiment H, the space saver pillow of alternative embodiment G, wherein the covering is a woven nylon with laminate.

According to alternative embodiment I, the space saver pillow of alternative embodiment G, wherein the air from within the bag is removed so that the space saver pillow is compressed no less than approximately 60%.

According to alternative embodiment J, the space saver pillow system of alternative embodiment G, wherein the air from within the bag is removed so that the space saver pillow is compressed within the range of approximately 60% to approximately 80%.

According to alternative embodiment K, a method for vacuum packing a space saver pillow comprises providing a space saver pillow comprising a fill and a covering surrounding and enclosing the fill, wherein the fill is adapted to be compressed and rebound back to its natural state upon decompression, placing the space saver pillow in a bag, lining the opening of the bag along a track, closing a cover, vacuuming the air out of the bag so as to compress the space saver pillow no more than about 80%, and heat sealing the bag.

According to alternative embodiment L, the method of alternative embodiment K, wherein the bag is comprised of plastic.

According to alternative embodiment M, the method of alternative embodiment K, wherein the fill is hollow-siliconized gametted polyester.

According to alternative embodiment N, the method of alternative embodiment K, wherein the covering is a woven nylon with laminate.

According to alternative embodiment O, the method of alternative embodiment K, wherein the air from within the bag is vacuumed so that the space saver pillow is compressed within the range of approximately 60% to approximately 80%.

According to alternative embodiment P, the method of alternative embodiment K, wherein the method further comprises opening the bag after the heat sealing of the bag, and removing the space saver pillow from the bag after the opening of the bag.

According to alternative embodiment Q, the method of alternative embodiment P, wherein the space saver pillow rebounds to at least about 80% of its original shape within approximately 4 hours.

According to alternative embodiment R, the method of alternative embodiment P, wherein the space saver pillow rebounds to at least about 90% of its original shape within approximately 24 hours.

According to alternative embodiment S, the method of alternative embodiment P, wherein the space saver pillow rebounds to greater than about 90% of its original shape within approximately 24 hours.

According to alternative embodiment T, the method of alternative embodiment P, wherein the method further comprises shaking the space saver pillow by grasping at its opposite edges.

According to alternative embodiment U, a space saver pillow system comprises a space saver pillow having a fill and a covering surrounding and enclosing the fill, the fill being adapted to generally rebound back to its natural state after being compressed; and a bag enclosing the space saver pillow an amount of air, wherein the space saver pillow enclosed in the bag is compressed no more than approximately 80% of its original size.

According to alternative embodiment V, a space saver pillow system comprises a space saver pillow having a hollow-siliconized garnetted polyester fill and a covering surrounding and enclosing the fill; and a bag enclosing the space saver pillow and an amount of air, wherein the space saver pillow enclosed in the bag is compressed no more than approximately 80% of its original size.

According to alternative embodiment W, a method for vacuum packing a space saver pillow comprises providing a space saver pillow comprising a fill and a covering surrounding and enclosing the fill, wherein the fill is adapted to be compressed and generally rebound back to its natural state upon decompression; placing the space saver pillow in a bag; vacuuming the air out of the bag so as to compress the space saver pillow no more than approximately 80% of its original size; and heat sealing the bag.

According to alternative embodiment X, a space saver pillow system comprises a space saver pillow having a fill and a covering surrounding and enclosing the fill, the fill being adapted to generally rebound back to its natural state after being compressed; and a bag enclosing the space saver pillow and an amount of air, wherein the space saver pillow is compressed to a portion of its original size while remaining capable of rebounding back to its natural state, the space saver pillow being compressed from approximately 60% to approximately 80% of its original size.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A method for packing a space saver pillow comprising:

providing a space saver pillow comprising a fill and a covering surrounding and enclosing the fill, wherein the fill is formed from a plurality of layers, each of the plurality of layers having a predetermined amount of fill material and being laid at an angle such that the fill is adapted to be compressed and generally rebound back to its original size upon decompression; and compressing the space saver pillow no more than approximately 90%.

2. The method of claim 1, wherein the angle is about 45 degrees.

3. The method of claim 1, wherein the fill is a hollow-siliconized garnetted polyester.

4. The method of claim 1, further comprising:

placing the space saver pillow in a bag; and sealing the bag.

5. The method of claim 4, wherein the bag is comprised of plastic.

6. The method of claim 4, wherein the compressing comprises vacuuming air out of the bag.

7. The method of claim 6, wherein the air from within the bag is vacuumed so that the space saver pillow is compressed within the range of approximately 60% to approximately 90%.

8. The method of claim 4, wherein the method further comprises:

opening the bag after the sealing of the bag; and removing the space saver pillow from the bag after the opening of the bag.

9. The method of claim 8, wherein the predetermined amount and the angle are such that the space saver pillow rebounds to at least about 80% of its original size within approximately 1 to 4 hours of removing the space saver pillow from the bag.

10. The method of claim 8, wherein the predetermined amount and the angle are such that the space saver pillow rebounds to at least about 90% of its original size within approximately 24 hours of removing the space saver pillow from the bag.

* * * * *